United States Patent [19]

Roberts et al.

[11] 4,013,852

[45] Mar. 22, 1977

[54] EXPULSION INTERRUPTION DEVICE FOR HIGH VOLTAGE SWITCHES

[75] Inventors: Gerald Bernard Roberts, Paris; Richard Eugene Roberts, Centralia, both of Mo.

[73] Assignee: A. B. Chance Company, Centralia, Mo.

[22] Filed: Feb. 10, 1975

[21] Appl. No.: 548,561

[52] U.S. Cl. ..... 200/146 R

[51] Int. Cl.[2] ..... H01H 33/12; H01H 9/38

[58] Field of Search ..... 200/146 R, 144 R

[56] References Cited

UNITED STATES PATENTS 3,308,259 3/1967 Hulteen et al. ..... 200/146 R

*Primary Examiner*—Robert S. Macon

*Attorney, Agent, or Firm*—Schmidt, Johnson, Hovey & Williams

[57] ABSTRACT

A completely self-enclosed, weatherproof expulsion interruption device is disclosed which includes a detachable, arc-suppressing tube assembly which can be readily replaced in the field as needed, in conjunction with novel spring-loaded expulsion actuation mechanism for quickly breaking a high voltage circuit with only a minimum of objectionable arcing across the internal tube contacts of the device. The interrupter is especially adapted for use with high voltage, manually operable, blade-type switches and safely overcomes problems associated with arcing across switch contact points during opening thereof. As the switchblade is opened and engages the actuating arm of the interrupter, current is passed in shunt relationship through the interrupter until the respective switch contacts are safely parted. At this point spring-loaded trip mechanism within the interrupter housing quickly breaks the shunt circuit within the arc-suppressing tube of the interrupter to thereby harmlessly break the circuit without burning or pitting of the main switch contacts. The trip mechanism also includes return means for reestablishing the shunt path through the interrupter after each operation thereof.

4 Claims, 8 Drawing Figures

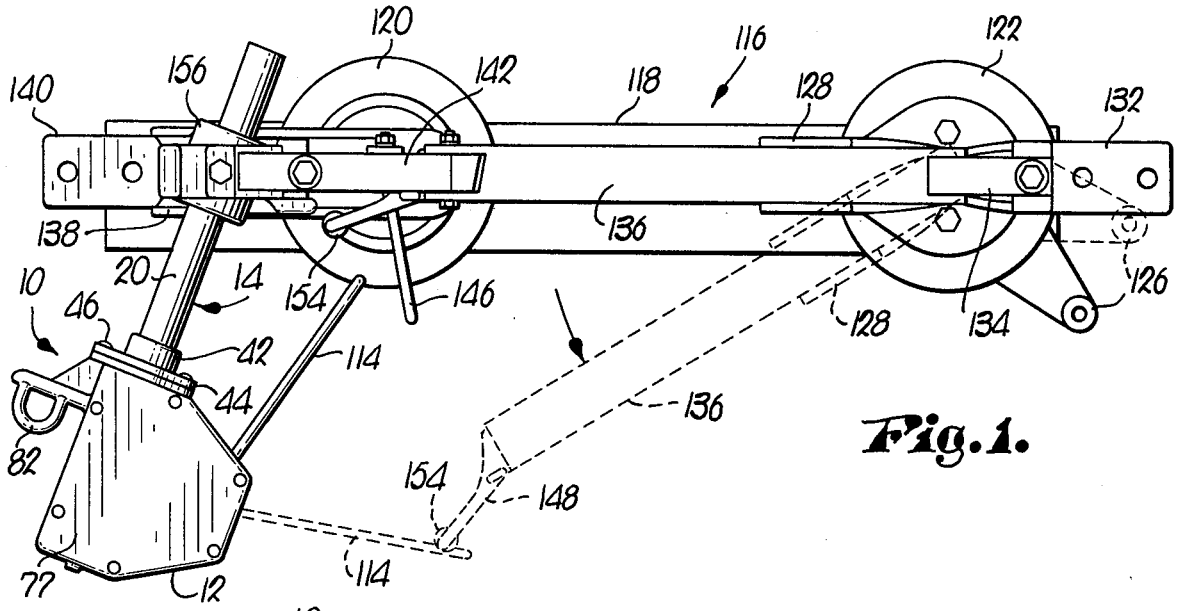
Fig. 1.
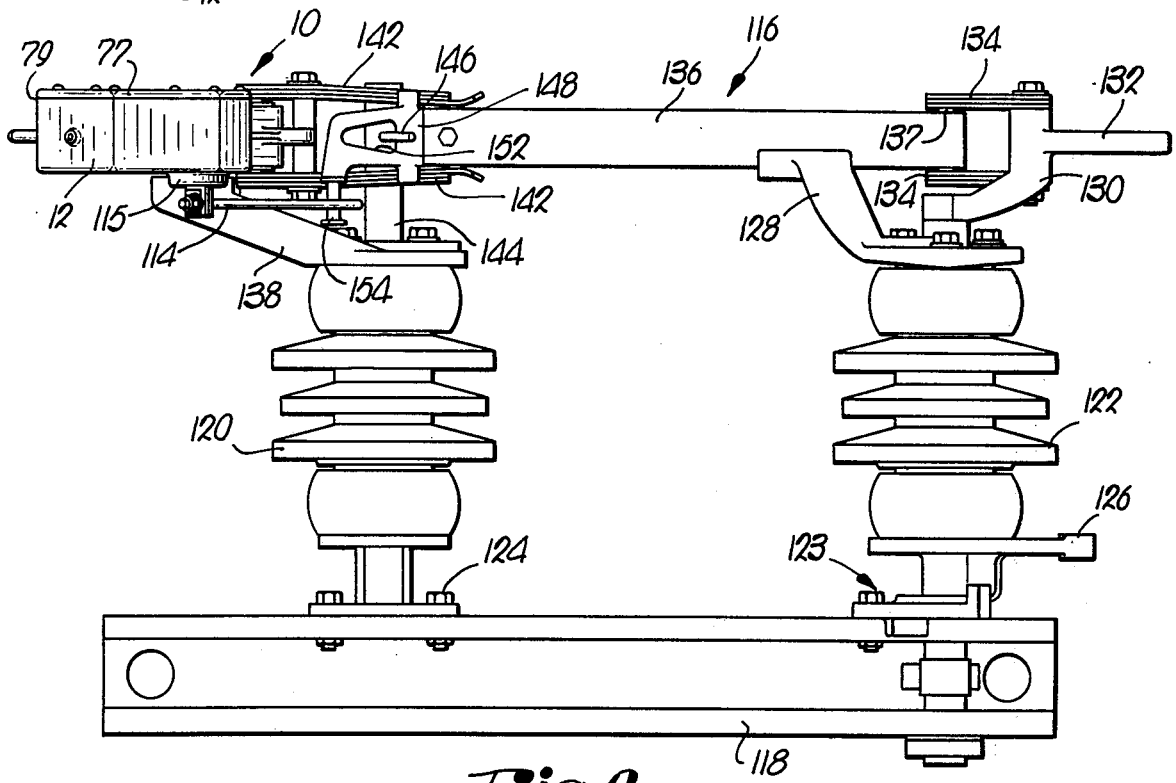
Fig. 2.
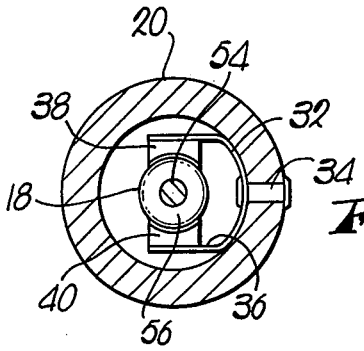
Fig. 7.
Fig. 8.
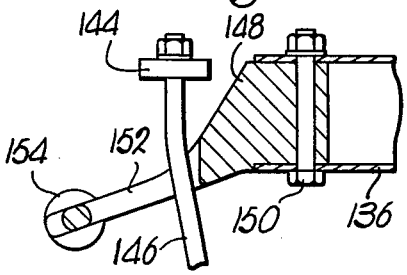

Fig. 3.
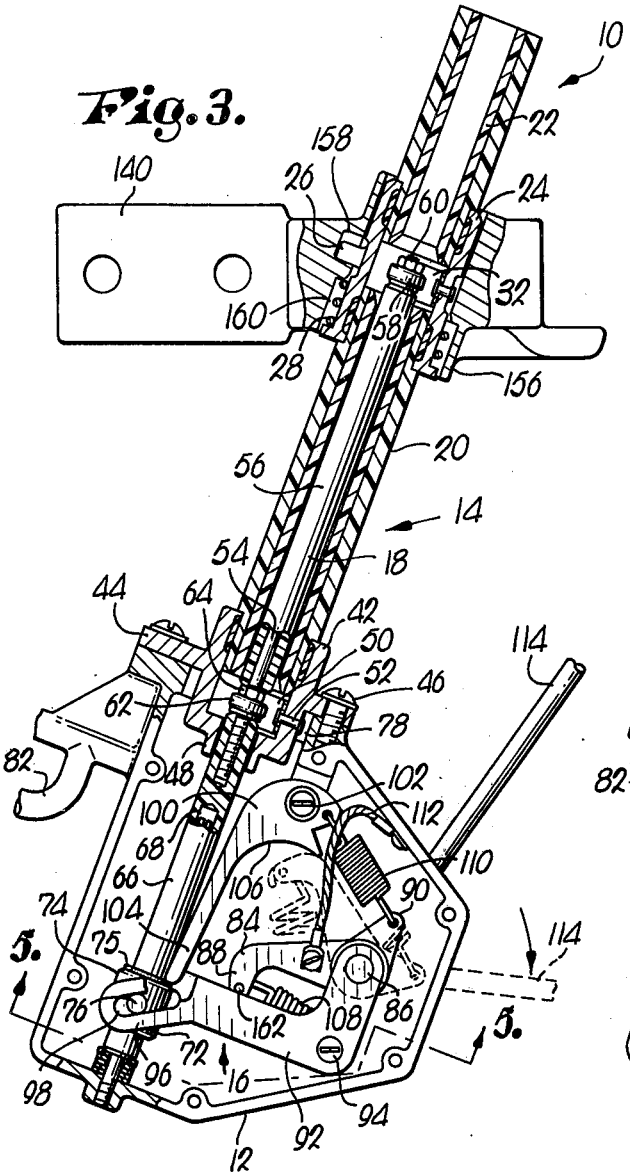
Fig. 4.
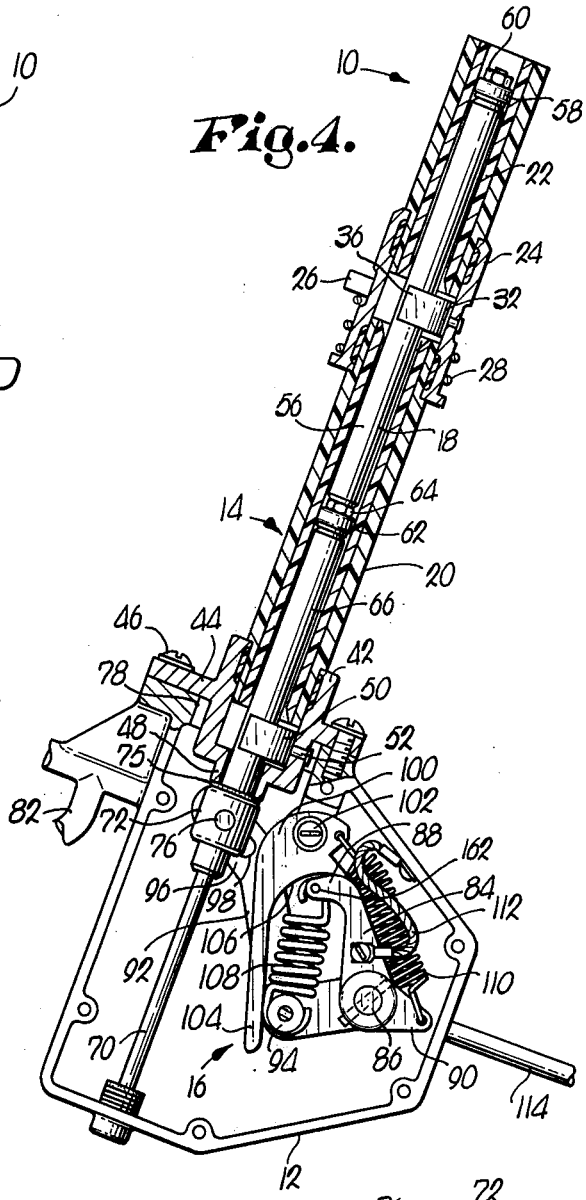
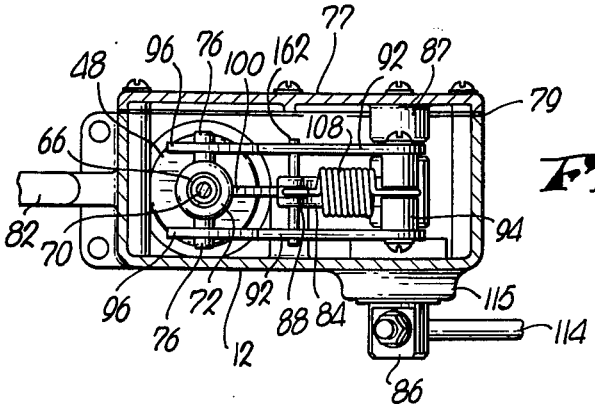
Fig. 5.
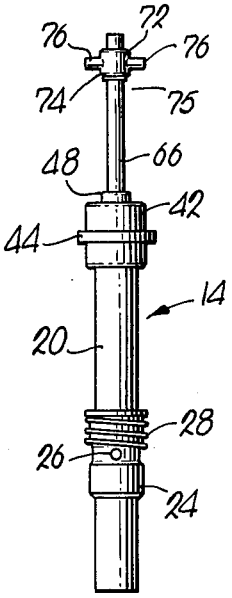
Fig. 6.

EXPULSION INTERRUPTION DEVICE FOR HIGH VOLTAGE SWITCHES

This invention relates to a reliable, weatherproof expulsion interrupter adapted to be mounted on a blade-type circuit switch to serve as means for safely breaking high-voltage currents during opening of the switch, thus obviating problems associated with burning or pitting of the switch contacts. More particularly, the invention is concerned with the interrupter of the described type having a removable arc-suppression tube assembly which can be replaced as needed in the field, with spring-loaded, completely self-enclosed trip mechanism operable to actuate the interrupter upon opening of the main switchblade a sufficient distance to clear the main switch contacts thereof.

In the use of high voltage electrical transmission and distribution equipment, it is common practice to provide manually operable blade-type switches which can be opened as needed to break the flow of current. These are often provided proximal to transformers or other equipment in order that linemen working on such equipment can first interrupt the flow of electrical current thereto. In general, such switches comprise a pair of spaced insulators with a pivotally movable switchblade therebetween which is electrically connected between respective switch terminals. The latter are connected by way of short lead lines to adjacent primary conductors, or other equipment, and the entire switch assembly is conventionally mounted on a cross-arm or pole. When the blade of the switch is swung open by means of conventional hot-line tools or the like, the circuit is broken between the switch terminals to interrupt the flow of current.

While blade-type switches have proven to be satisfactory for use with circuits carrying relatively low voltages, they are generally not satisfactory when employed with transmission and distribution lines carrying higher voltages on the order of 15,000 volts or more. This stems from the fact that when the fixed and movable contacts of the switch are in proximal relationship during opening and closing of the switchblade, a significant problem of arcing between the contacts results. Such arcing can cause the contacts to become burned or pitted only after a few opening and closing sequences, thus necessitating their removal of even replacement of the entire switch assembly.

In an attempt to overcome the problems associated with arcing across switch contacts, users of such equipment have employed devices known in the art as expulsion interrupters. In general, these interrupters are mounted on the switch itself adjacent the blade thereof. As the switch is opened, the movable contact on the blade engages the interrupter thereby defining a shunt circuit through the interrupter during the opening of the switch. When the fixed and movable contacts are sufficiently parted, the interrupter actuates to quickly break the shunt circuit and thus interrupt the flow of current. In order to accomplish this result in a safe manner, such interrupters generally include open-ended tubes composed of arc suppressing material which receive a movable plunger assembly forming part of the shunt circuit. When the interrupter actuates, the plunger assembly is axially shifted within the surrounding arc-suppressing tube to break the shunt circuit. In these circumstances, any arc produced across the internal contacts of the interrupter is quickly suppressed and hot gases or the like generated by such are expelled from the tube.

One variety of commercial interrupter assemblies presently in use are depicted in U.S. Pat. Nos. 3,205,330 and 3,514,560 to Bridges. These interrupters include a pivotally mounted, conductive actuating arm disposed for engagement with an openable switchblade such that the interrupter is operated upon opening of the latter. The actuating arm is coupled by means of an external, hinge-like connection assembly to a plunger rod telescopically received within an arc-suppressing expulsion tube. Upon opening of the switchblade the actuating arm trips the drive mechanism of the interrupter to shift the plunger rod to the electrical disconnect position. Thereafter, upon closing of the switch-blade, the actuating arm is again engaged to shift the actuating arm back to its original operative position.

While the patented interrupters described above have found acceptance in the art, they nevertheless are plagued with a number of troublesome problems. Most importantly, because of the external connection between the actuating arm and plunger rod, these components are exposed to the deleterious effects of the weather. For example, during wintertime conditions, the hinge-like connection between the actuating arm and plunger rod has been known to ice over and lead to a faulty operation of the unit. Moreover, by virtue of the exposed nature of these components, they of necessity must be fabricated from weather resistant materials which, of course, increases the overall cost of the interrupter.

These prior art interrupters often pose another operational problem resulting from the lack of any structure ensuring automatic recocking of the interrupter upon reclosing of the main switch. That is, if the switch blade is not moved to its full open position during the opening sequence, reclosing thereof may not cock the interrupter for further use. As can be appreciated, this leaves the switch totally unprotected and subject to arcing-over problems or the like during later openings.

Another problem associated with this type of prior interrupter stems from the fact that the tube and plunger assembly thereof cannot be replaced. This is objectionable since the tube and plunger assembly can become unacceptably burned and pitted after only a few operatonal sequences of the interrupter, notwithstanding the fact that the remainder of the interrupter unit remains fully operable. This in turn necessitates replacing the entire unit when only one portion thereof is defective, which is of course an expensive proposition.

It is therefore the most important object of the present invention to provide an arc-suppressing interrupter assembly which overcomes the problems of icing and weathering of the actuation and drive mechanism thereof by provision of a housing enclosing the drive and plunger assemblies of the interrupter in order that the latter can be operated under all ambient weather conditions without fear of the harmful effects of the latter.

Another aim of the invention is to provide a weatherproof interrupter assembly having a unique actuating assembly which is operable to quickly shift the plunger rod telescoped within the arc-suppressing tube thereof, such that high voltage currents can be safely interrupted with only a minimum of arcing across the internal interrupter contacts.

A still further object of the invention is to provide an interrupter assembly having a completely removable plunger assembly comprising an elongated, tubular explusion tube and a plunger rod telescopically received therein, such that the plunger assembly can be readily changed in the field without the necessity of discarding the entire interrupter itself.

In the drawings:

FIG. 1 is a top plane view of a blade-type circuit-breaking switch having the interrupter of the present invention mounted thereon, with the operation of the overall assembly depicted in phantom;

FIG. 2 is a side elevational view of the switch and interrupter assembly illustrated in FIG. 1;

FIG. 3 is a fragmentary view in vertical section of the assembly illustrated in FIGS. 1 and 2, showing the details of the interrupter unit when the latter is in its normal, shunt circuit-defining position;

FIG. 4 is a fragmentary view in partial vertical section illustrating the present interrupter in its actuated, circuit-breaking disposition;

FIG. 5 is a fragmentary sectional view taken along irregular line 5—5 of FIG. 3;

FIG. 6 is a side elevational view of the movable tube and plunger assembly forming a part of the present interrupter;

FIG. 7 is an enlarged sectional view illustrating one of the internal tube contacts of the interrupter; and FIG. 8 is an enlarged, fragmentary view in partial vertical section showing the physical arrangement between the movable switchblade contact and arcing horn of the switch unit.

An interrupter 10 is depicted in detail in FIGS. 3–5 and broadly includes a closed housing 12 with an elongated tubular arc-suppressing tube 14 connected thereto. Housing 12 encloses a actuating drive mechanism broadly designated by the numeral 16, as well as the upper end of plunger rod 18 which is telescopically received within tube 14. Mechanism 16 is operable to axially shift plunger rod 18 within tube 14 as will be seen from a comparison of FIGS. 3 and 4.

In particular, tube 14 includes an outer weatherproof synthetic resin protective sheath 20 and an inner, bore-defining portion 22 formed of organic arc-suppressing material. A metallic annular connection collar 24 is situated adjacent the open end of tube 14 and includes an outwardly projecting bayonet stud 26 with a helical spring 28 adjacent the latter and captured between stud 26 and the uppermost annular lip 30 of collar 24. A generally U-shaped contact 32 is attached to collar 24 by means of a conventional rivet 34 and extends through the arc-suppressing material of bore-defining portion 22 and outer tube 20. Referring specifically to FIG. 7, it will be seen that contact 32 includes a springable metallic, generally U-shaped member 36 with a pair of opposed, metallic contact sections 38 and 40 cooperatively defining a space therebetween for the reception of plunger rod 18.

A mounting ferrule 42 is secured adjacent the end of tube 14 proximal to housing 12. Ferrule 42 includes a threadably bored-mounting flange 44 adapted to receive a plurality of screws 46 for the purpose of removably attaching tube 14 to housing 12. As depicted in FIGS. 3 and 4, ferrule 42 extends into the confines of housing 12 and terminates in an annular portion 48 of diameter to receive plunger rod 18 in a closely fitting, slidable manner. A second generally U-shaped contact 50 is connected to the midportion of ferrule 42 by means of rivet 52, second contact 50 being identical in every respect with contact 32 described in detail above.

Elongated plunger 18 is telescopically received within tube 14 and includes an internal conductive metal core 54 which is threaded on its respective ends, along with an outer sleeve 56 of insulative synthetic resin material. An annular metallic contact ring 58 is attached to the lowermost end of core 54 and is secured thereto by means of nut 60. Similarly, a second annular contact ring 62 is attached to the upper threaded end of core 54 by means of a nut 64. As best illustrated in FIG. 3 the respective connection rings 58 and 62 are spaced such that when plunger rod 18 is in its normal rest position, the rings are in snugly fitting electrical contact with the U-shaped tube contacts 32 and 50.

An elongated, axially aligned synthetic resin section 66 forming a part of plunger 18 is attached to the uppermost end of core 54 and extends into the confines of housing 12. Section 66 is axially bored as at 68 and receives an elongated guide rod 70 attached to housing 12 for the purpose of guiding plunger 18 during axial shifting thereof. In addition, section 66 includes an annular ferrule 72 at the uppermost end thereof which includes a lowermost lip portion 74, and a pair of opposed, outwardly extending studs 76. An annular resilient washer 75 is also affixed adjacent lowermost lip portion 74 of annular ferrule 72.

Housing 12 is a hollow, metallic, generally polygonally-shaped member which has removable lid 77 and asbestos gasket 79 for the purpose of completely closing the same. In addition, housing 12 includes a connection aperture 78 in one side thereof which is defined by threaded mounting flange 80 complemental with mounting flange 44 of tube 14. As depicted in the drawings, screws 46 are utilized to removably connect tube 14 to housing 12. Finally, housing 12 includes an integrally mounted external eye 82 which facilitates installation of the interrupter through the use of conventional hot-line tools or the like.

Drive mechanism 16 includes a pivotally mounted crank 84 which is rigidly secured to transverse shaft or axle 86 which extends through permanent wall 81 of housing 12. The remaining end of axle 86 is rotatably journaled within a complementary, recessed boss 87 affixed to the inner face of removable lid 77. An insulative sleeve (not shown) is also positioned between axle 86 and boss 87 to preclude burning or pitting of those metallic components. It will be appreciated that provision of boss 87 facilitates operation of drive mechanism 16 and ensures that axle 86 is not subjected to undesirable cantilever loads during such operation. Crank 84 is an elongated, metallic member including an upturned lip portion 88 and an apertured tail section 90. A pair of identical, generally L-shaped brackets 92 are likewise pivotally secured over axle 86 and are interconnected together by means of bolt and spacer assembly 94 at the respective apexes thereof. Each bracket 92 includes an integral, angularly disposed connection portion 96 at the remaining end thereof which has an elongated slot 98 therein receiving one of the studs 76 of extension ferrule 72 mounted on extension 66. Although brackets 92 and crank 84 are coaxially mounted within housing 12 on axle 86, it is important to note that these are pivotal independently of one another, as will be more fully described hereinafter.

An elongated stop arm 100 is pivotally secured within housing 12 adjacent aperture 78 thereof by means of a conventional bolt assembly 102. Arm 100 is a conductive metallic member which includes an elongated finger portion 104 adapted to engage lip portion 74 of ferrule 72 through annular resilient washer 75. An arcuate camming surface 106 is also provided on stop arm 100 proximal to crank 84.

A helical power spring 108 is connected at its respective ends to lip portion 88 of crank 84 by pin 162 and to bolt and spacer assembly 94. A helical return spring 110 is similarly attached between tail section 90 of crank 84 and stop arm 100 adjacent the pivotal connection of the latter. Finally, a conductive pigtail 112 is connected between crank 84 and a sidewall of housing 12.

An actuating arm 114 is mounted an axle 86 adjacent the exterior of permanent wall 81 of housing 12. An annular synthetic resin washer assembly 115 is interposed between wall 81 and arm 114 and also between housing 12 and axle 86, in order to insure smoother pivoting of the latter. Arm 114 and crank 84 are fixedly secured to axle 86 such that the crank rotates in response to movement of external arm 114. However, brackets 92 are simply pivotal about the axis of axle 86 but are not positively secured thereto.

Referring now to FIGS. 1 and 2, interrupter 10 is illustrated in operative conjunction with a blade-type switch 116. The latter includes a metallic mounting channel 118 with a pair of spaced, skirted insulators 120 and 122 connected to the latter. Insulator 120 is fixedly mounted on channel 118 by means of bolts 124, while insulator 122 is rotatably secured to channel 118 through conventional means 123. Insulator 122 includes a crank attachment 126 at the lowermost end thereof, and a conductive support arm 128 at the top thereof. In addition, an irregularly-shaped support casting 130 is attached to insulator 122 and includes and apertured lead line terminal 132, with a pair of spaced, opposed, laminated metallic connection assemblies 134 secured thereto. An elongated, tubular switchblade 136 is pivotally secured between connection assemblies 134 by means of pivot pin 137, and is coupled to arm 128 such that when insulator 122 is rotated, blade 136 moves in unison therewith.

Insulator 120 also has an irregular support casting 138 having an apertured lead line terminal 140. A pair of spaced, elongated, metallic, laminated connecting assemblies 142 are also supported and attached to casting 138 for the purpose of receiving the movable end of switchblade 136, and thus defining the stationary switch contact. In addition, an upright, post-like element 144 is attached to the upper end of insulator 122 and supports an elongated, transversely disposed, removable arcing horn 146.

A replaceable contact block 148 is secured within the open end of tubular switchblade 136 by means of conventional bolt assembly 150. Block 148 includes a generally triangularly-shaped opening 152 for the purpose of receiving arcing horn 146, along with a depending contact stud 154 which is adapted to engage actuating arm 114 of interrupter 10. Referring specifically to FIG. 8, it will be seen that opening 152 is configured such that when blade 136 is in its normally closed, circuit-defining position, arcing horn 146 does not contact block 148 and thus no shunt circuit is defined at such times through the arcing horn.

Turning now to FIGS. 1 and 3, it will be seen that switch 116 includes an obliquely oriented, generally tubular mounting socket 156 which is adapted to removably receive collar 24 of interrupter 10. In particular, mounting socket 156 has a bayonet slot 158 and a stepped inner sidewall 160. In mounting procedures, collar 24 of interrupter 10 is inserted within tubular socket 156 and axially twisted until stud 26 is securely received within slot 158. At this point, spring 28 is compressed in order to tensionably retain interrupter 10 within socket 156.

Thus, when interrupter 10 is mounted on switch 116 and the latter is in the normal, unactuated disposition thereof, a shunt circuit path is defined through arm 114, housing 12, ferrule 42, U-shaped contact 50, contact 62, core 54, contact 58, second U-shaped contact 32, collar 24, and ultimately through terminal 140. Pigtail 112 is also provided to ensure that a current path is established through arm 114 and housing 12, as will be readily apparent.

In practice, the switch and interrupter assembly described can be mounted on a crossarm or upright utility pole in any one of a number of possible orientations. Short lead lines (not shown) are normally employed to connect the respective terminals 132 and 140 to primary conductors or proximal electrical equipment (e.g., transformers or the like) such that the normal current load is carried through the blade-type switch.

When it is desired to interrupt the flow of current through switch 116, the following procedure is followed. First, the operator attaches a conventional crank assembly (not shown) to crank attachment 126 and begins to rotate insulator 122 and blade 136. As movement of blade 136 proceeds and before the main switch contacts have parted, contact block 148 first engages arcing horn 146 to define a first shunt circuit through the latter in order that no arcing occurs between the movable end of blade 136 and the stationary contact defined by connective assemblies 142. As blade 136 continues to rotate, depending arm 154 (FIG. 2) engages the proximal end of actuating arm 114 of interrupter 10 such that temporary parallel shunt circuits are defined through arcing horn 146 and interrupter 10 as described above. When blade 136 rotates sufficiently to clear arcing horn 146, the first shunt circuit is of course broken, but arcing between the main switch contacts does not occur by virtue of the shunt circuit through interrupter 10.

When blade 136 is moved sufficiently away from the stationary switch contact such that the possibility of arcing therebetween is effectively precluded, arm 114 has been pivoted as depicted in phantom in FIG. 1, to a point where the internal drive mechanism 16 can act to interrupt the shunt circuit through the interrupter. Referring now to FIGS. 3 and 4, this interruption sequence will be described in detail. First, as arm 114 pivots during the described outward movement of blade 136, internal crank 84 rotates within housing 12 in order to extend power spring 108. This extension proceeds until lip portion 88 of crank 84 comes into camming contact with cam surface 106 of stop arm 100. At this point, continued rotation of crank 84 has the effect of pivoting arm 100 out of engagement with lip portion 74 of extension ferrule 72. This action, in conjunction with the extension of power spring 108, causes plunger rod 18 to be axially shifted within tube 14 as illustrated in FIG. 4 until resilient washer 75 bottoms on the upper end of annular portion 48 of ferrule 42. This shifting motion has the effect of quickly breaking the electrical contact between rings 58 and 62 and U-shaped contacts 32 and 50. By virtue of the high voltages carried through interrupter 10, there will naturally be a tendency towards arc-formation between the internal tube contacts and connection rings during parting thereof. This arc formation is quickly suppressed by virtue of the arc-suppressing material defining the innermost portion 22 of tube 14. In addition, the expulsion gases generated during arc-suppression are allowed to pass out the open end of the tube 14 in order that untoward pressures do not buildup within tube 14.

After mechanism 16 has acted to safely interrupt the circuit through interrupter 10, return spring 110 comes into play. Specifically, during initial rotation of crank 84, return spring 110 is also extended such that when the interrupter is actuated, the return spring is operable to return all of the drive components to their original dispositions, as illustrated in FIG. 3. This is advantageous in that the spring components are in their relaxed positions at all times save during the actual interruption sequence, which increases the life of the drive mechanism 16. Return of the actuation mechanism is facilitated by provision of a transversely extending pin 162 in lip portion 88 of crank 84. As the latter is returned to its original rest position through the medium of return spring 110, the spaced brackets 92 are engaged and also lifted back to their original dispositions. In addition, stop arm 100 is pivoted back to its movement precluding position in engagement with lip 74 of extension ferrule 72 through the action of return spring 110.

When it is desired to close switch 116, the operator again manipulates the crank coupled to attachment 126 to turn blade 136 back toward the stationary switch contact. In this instance however, actuation arm 114 is not initially contacted but rather block 148 first engages arcing horn 146. During this engagement procedure, arcing will sometimes occur between block 148 and horn 146; however, by virtue of the removable nature of each of these components, they can be replaced at little cost if they become burned or pitted through extended use. As the closing sequence proceeds past this initial engagement, stud 154 again contacts arm 114 to thereby define separate shunt paths through the arcing horn and interrupter 10. However, at this time no objectionable arcing will occur between stud 154 and arm 114, in order to maximize the useful life of interrupter 10. The closing sequence is completed simply by rotating blade 136 back to its original, closed position, whereupon block 148 will completely clear arm 114. The switch in this disposition is again ready for further use.

Drive mechanism 16 includes a number of advantages not heretofore obtainable with the units of the prior art. In particular, by virtue of the two lever arrangements used, the space required for the overall drive assembly is minimized, thus permitting compact nesting of mechanism 16 within relatively small housing 12. In addition, because of the fact that power spring 108 is connected to the L-shaped bracket 92 at the respective apexes thereof, the velocity ultimately imparted to plunger rod 18 is "multiplied." This ensures that plunger rod 18 will quickly operate to interrupt the flow of current with the least possible arc formation.

Another important feature of the present invention resides in the removable nature of tube 14 and plunger rod 18. If the plunger rod and tube become excessively burned through continued use, the latter can be repaired with little difficulty. This procedure involves removing bolts 46 and the cover of housing 12, and loosening bolt assembly 94 interconnecting brackets 92. At this point, tube 14 and plunger rod 18 can be removed simply by pulling studs 76 out of their associated slots 98 in L-shaped brackets 92. A new unit is installed by inserting the end of a new plunger rod 18 into housing 12 and reattaching the same to L-shaped brackets 92. Reinstallation is completed simply by bolting a new tube 114 into place, as will be clearly apparent.

Thus, the present invention provides a novel interrupter apparatus which includes highly advantageous drive mechanism in conjunction with a removability feature, both of which greatly extend the useful life of the unit.

Having thus described the invention, what is claimed as new and desired to be secured by Letters Patent is:

1. An arc-suppressing interrupter adapted to be interposed in an electrical circuit in conjunction with a blade-type disconnect switch for actuating the interrupter, the latter comprising:

a closed housing;

an elongated expulsion tube attached to said housing and in communication with the interior thereof, the interior of said tube being formed of arc-suppressing material;

spaced electrical contacts within said tube;

means for electrically connecting one of said contacts with said circuit;

an elongated, axially shiftable plunger rod telescopically received within said tube and extending into said housing, said rod being operable in the rest position thereof to electrically connect said spaced contacts, and to electrically disconnect the same upon axial shifting of the rod;

a conductive, shiftable actuating arm mounted externally of said housing and in disposition for engagement with the blade of said switch during opening of the latter, said arm being engageable and shiftable with said blade during opening thereof prior to termination of current flow through said blade;

means electrically connecting said actuating arm and the other of said electrical contacts for defining a shunt path through the latter and said plunger rod normally electrically interconnecting the spaced contacts; and actuating means positioned within said housing and operably coupled to said plunger rod and actuating arm respectively, said actuating means including:

a generally L-shaped link having elongated first and second leg sections, said link being operably coupled adjacent the end of said first leg section to said plunger rod, and pivotally supported within said housing at a point adjacent the end of said second leg section;

an elongated crank having link-engaging structure thereon pivotally supported intermediate the ends thereof within said housing and operably coupled with said actuating arm for pivoting of the crank in response to said movement of the actuating arm;

a stop arm pivotally supported within said housing adjacent one end of the stop arm, with the remaining end thereof normally being in operative movement-blocking engagement with said plunger rod;

a drive spring operatively connected between one end of said crank and said link;

a return spring interconnected between said stop arm adjacent the pivotal connection thereof, and said crank adjacent the end thereof remote from said drive spring;

said link, crank, stop arm drive spring and return spring being cooperatively located and arranged for extending said drive spring and tensionably energizing the same upon pivoting of said crank in response to said movement of the activating arm, and for extending and tensionably energizing said return spring upon said pivoting of said crank, said stop arm and crank having respective engagement surfaces located for causing said crank to engage said stop arm, after the crank has been pivoted a predetermined distance to accomplish said tensionable energization of said drive and return springs, for pivoting of said stop arm out of said movement-blocking disposition to clear said plunger rod, in order to permit said drive spring to quickly pull said link towards said crank with consequent deenergization of said drive spring for axial, electrical disconnecting movement of said plunger rod, said return spring, after said deenergization of said drive spring, being operable for simultaneously pivoting said stop arm and crank for causing said link-engaging structure to engage said link for return movement of said plunger rod back to said rest position, and for return movement of said stop arm back to said normal movement-blocking disposition.

2. The interrupter as set forth in claim 1, wherein said crank arm and link are coaxially mounted within said housing and are pivotal independently of one another.

3. The interrupter as set forth in claim 1, wherein said drive spring is operatively connected to said link at approximately the apex thereof.

4. The interrupter as set forth in claim 1, wherein said crank is normally adjacent said link and nested within the recess cooperatively presented between said first and second leg sections thereof.

* * * * *